United States Patent [19]

Leskovec et al.

[11] 4,065,112

[45] Dec. 27, 1977

[54] HYDRAULIC JACK CUSHIONING APPARATUS

[75] Inventors: Edward V. Leskovec, Eastlake; Ralph D. Porter, Euclid, both of Ohio

[73] Assignee: Towmotor Corporation, Mentor, Ohio

[21] Appl. No.: 716,847

[22] Filed: Aug. 23, 1976

[51] Int. Cl.[2] ..... B66F 3/24

[52] U.S. Cl. ..... 267/34; 254/93 R; 267/126

[58] Field of Search ..... 267/34, 126, 65 R, 65 A, 267/124; 254/93 H, 93 R

[56] References Cited

U.S. PATENT DOCUMENTS

| | | | |
|---|---|---|---|
| 2,526,148 | 10/1950 | McLean | 254/93 R |
| 3,782,689 | 1/1974 | Barosko | 254/93 R |

FOREIGN PATENT DOCUMENTS

| | | | |
|---|---|---|---|
| 712,930 | 7/1965 | Canada | 267/126 |

*Primary Examiner*—James B. Marbert
*Attorney, Agent, or Firm*—James R. Bell

[57] ABSTRACT

Cushioning apparatus for cushioning a hydraulic jack is disclosed which includes a plunger reciprocably mounted within a blind bore. The plunger sequentially closes off a plurality of axially spaced orifices provided through the wall of the bore as the plunger moves from a first position adjacent the open end of the bore to a second position adjacent its closed end, thereby progressively restricting the escape of fluid from the bore so as to slow the movement of one of the telescopic members of the jack toward another.

9 Claims, 3 Drawing Figures

HYDRAULIC JACK CUSHIONING APPARATUS

BACKGROUND OF THE INVENTION

The present invention relates to apparatus for cushioning the impact of one telescopic member of a hydraulic jack against another.

Multi-stage, single acting hydraulic jacks, such as used as lift jacks on lift trucks and the like, are permitted to retract under free-fall conditions when supporting relatively heavy loads. Occasionally, the telescopically disposed members of the jack impact against each other at the bottom of their strokes with sufficient force to cause an undesirable noise and even structural damage to the jack.

SUMMARY AND OBJECTS OF THE INVENTION

In accordance with the present invention, apparatus for cushioning the movement of one telescopic member toward another of a hydraulic jack is provided having a wall member carried by one of the telescopic members for forming a blind bore having an open end and an opposite closed end; a plunger reciprocably mounted within the blind bore for movement between a first position adjacent the open end of the bore and a second position adjacent its closed end and defining a variable chamber therebetween; a surface carried on the other of the telescopic members for engagement with the plunger to effect its displacement toward its second position as the telescopic members approach a predetermined position relative to each other; and a plurality of axially spaced orifices formed through the wall member between the first and second positions of the plunger so as to be sequentially closed off by the plunger as it moves towards its second position, thereby progressively restricting the escape of fluid from the chamber as the plunger approaches its second position. Such cushioning apparatus is effective in decelerating the telescopic members of the jack as they come together, thereby alleviating any impact therebetween.

The apparatus of this invention is also readily adaptable to multi-stage hydraulic jacks and is relatively simple in construction and inexpensive to manufacture.

Other advantages of the present invention will become more readily apparent upon reference to the accompanying drawings and the following description.

DESCRIPTION OF THE PREFERRED EMBODIMENT

Figure 1:
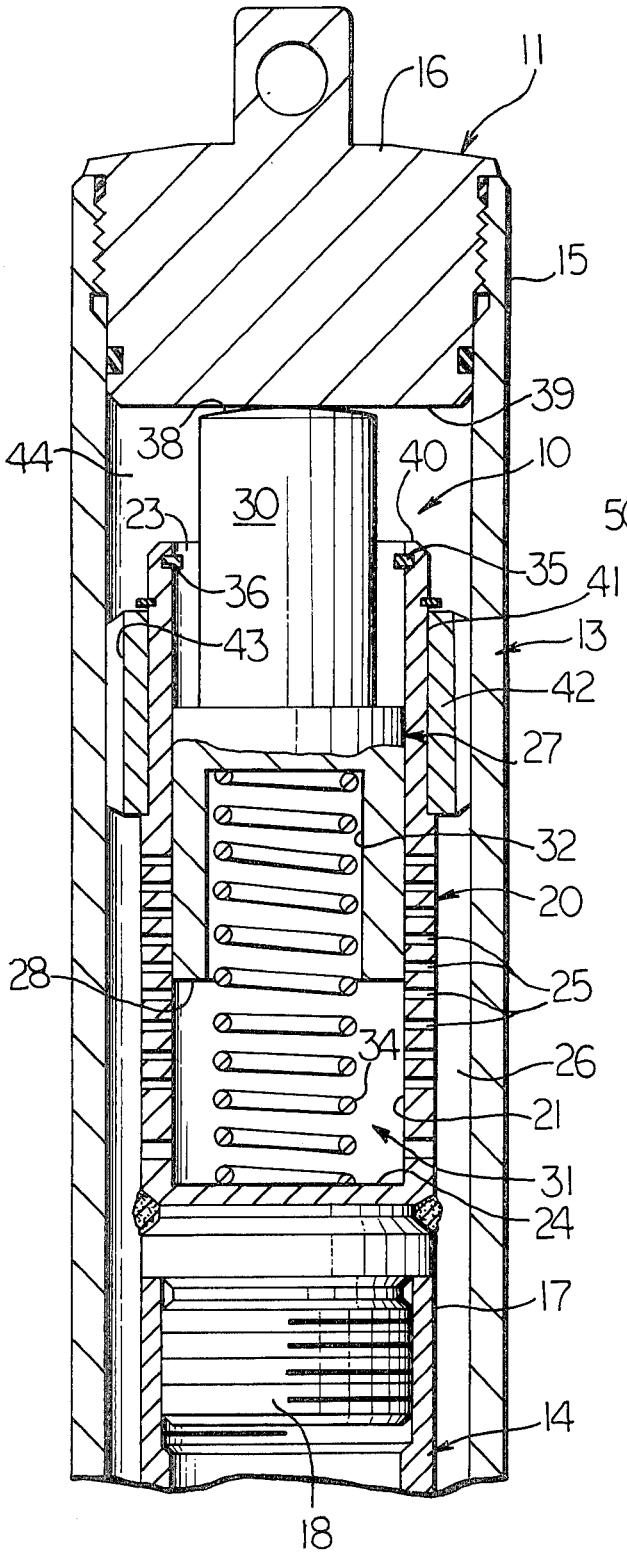
FIG. 1 is a vertical cross sectional view of one end of a hydraulic jack with the cushioning apparatus embodying the principles of the present invention.

Referring more particularly to the drawings, cushioning apparatus embodying the principles of the present invention is generally indicated at 10 in FIG. 1 for use in association with a multi-stage hydraulic jack, one end of which is shown at 11. The multi-stage jack 11 may be of any conventional design of the type commonly employed for lifting the mast of a lift truck or the like, not shown, and only those elements of the jack necessary for an understanding of the present invention will be described herein.

Such jack 11 includes an outer telescopic member or hollow cylinder 13 and an inner telescopic member or hollow cylinder 14 mounted in spaced relation within the outer member 13. The outer member 13 has an upper end portion 15 closed by an end cap 16 which is preferably screw threadably or otherwise secured thereinto. The jack 11, it will be understood, is of the single acting type and, therefore, does not need a fluid line to its upper end. The inner telescopic member 14 also has an upper end portion 17 which is closed by a plug 18.

In accordance with the present invention, the cushioning apparatus 10 in the preferred embodiment shown in FIG. 1 includes a cylindrical wall member or metering sleeve 20 for forming a blind bore 21. The blind bore includes an upper open end 23 and an opposite closed end 24. The sidewall of the sleeve is provided with a plurality of axially spaced orifices 25 adjacent the closed end portion of the bore, which orifices communicates the bore with an annular chamber 26 defined between the outer and inner telescopic members 13 and 14 respectively.

The cushioning apparatus 10 also includes a plunger 27 which is reciprocably mounted within the blind bore for movement between a first position adjacent the open end of the bore and a second position adjacent its closed end. The plunger has an end face 28 at one end thereof and an elongated stem 30 extending from its other end. A variable chamber 31 is formed in the blind bore 21 between the end face 28 of the plunger and the closed end 24 of the bore. A spring cavity 32 is preferably provided in the end face 28 of the plunger for seating one end of a biasing spring 34. The other end of such spring is seated against the closed end 24 of the bore 21 and is effective in normally biasing the plunger toward its first position. A snap ring 35 is seated within a groove 36 formed about the bore adjacent its open end 23 for retaining the plunger within the bore.

The elongated stem 30 of the plunger is preferably provided with a crown head 38 at its distal end for self aligning engagement against an inner transverse surface 39 of the end cap 16. The inner transverse surface 39 also serves as a stop for abutting engagement against an end fsurface 40 on the sleeve 20. The sleeve 20 is also preferably provided with a reduced diameter upper end portion 41 about its periphery for mounting an annular guide member 42. The guide member, of course, is sized for sliding engagement within the hollow inner periphery of the outer telescopic member 13 for guiding the reciprocating movement thereof relative to the inner telescopic member 14 in a usual manner. A plurality of axial slots 43 are formed in the periphery of the guide member 42 to communicate fluid from the chamber 26 on the one side thereof to a chamber 44 formed between the end portions of the inner and outer telescopic members 14 and 13, respectively.

OPERATION

While the operation of the present invention is believed clearly apparent from the foregoing description, further amplification will subsequently be made in the following brief summary of such operation. Assuming that the inner telescopic member 14 is rigidly anchored, the introduction of hydraulic fluid into the annular chamber 26 between the telescopic members will pass through the slots 43 in the guide member 42 and into the chamber 44. The pressure of such fluid will react against the inner surface of the end cap to effect the lifting of the outer telescopic member 13 relative to the inner member 14. When this occurs, the end cap will disengage from the plunger 27, allowing the plunger to be moved by the spring 34 from the intermediate position in which it is shown in FIG. 1 to its first position wherein the plunger is against the snap ring 35. Fluid in the chamber 26 also enters through the orifices 25 to fill the chamber 31.

To retract or collapse the jack 11, it will be understood that the chamber 26 is vented to tank in any suitable manner, not shown, which allows the outer telescopic member 13 to decend upon the inner member 14. When the jack is supporting a heavy load, it will be appreciated that the gravitational forces acting on the outer member will cause it to decend quite rapidly which, without the present cushioning apparatus, would cause the end cap 16 of the outer member to impact against the end of the inner member, causing possible damage to the jack.

However, with the present cushioning apparatus 10 being employed, when the jack approaches the end of its decent stroke, the inner surface 39 of the end cap 16 will contact the stem 30 of the plunger 27, causing the plunger to move toward its second position. Such movement, however, is dependent upon the expulsion of the fluid from within the chamber 31 which is possible only through the orifices 25. As the plunger proceeds further into the blind bore 21, the lower or end face 28 thereof sequentialy passes the axially spaced orifices so as to cause the escape path of the fluid from the chamber to be progressively restricted. As a result, a counteracting force is developed within the chamber which is effective in decelerating the movement of the outer member in the last stages of the decent stroke of the jack for stopping the outer member in a smooth, controlled manner so as to alleviate any substantial impact between the end surface 40 of the sleeve 20 with the inner face 39 of the end cap 16.

DESCRIPTION OF THE ALTERNATE EMBODIMENT

Figure 2:
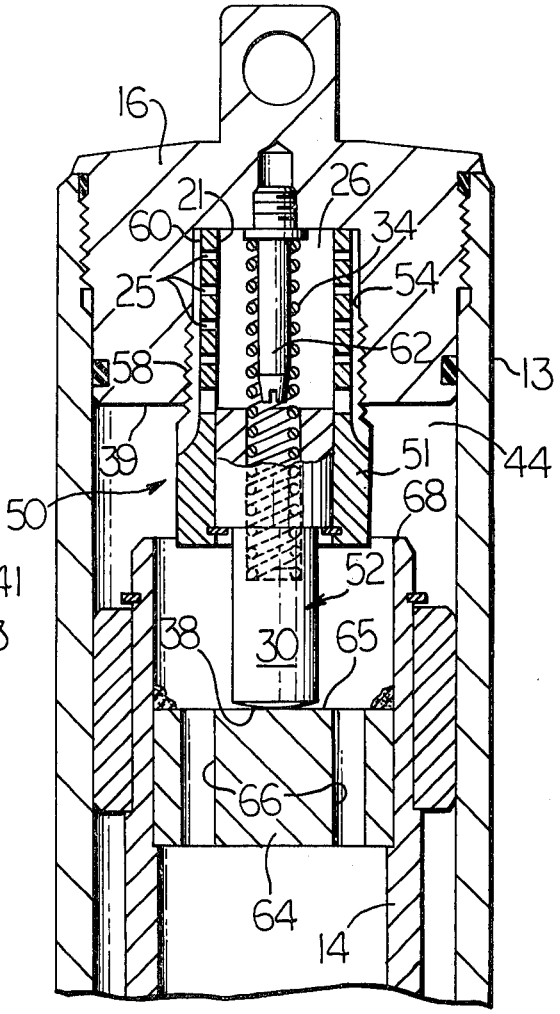
FIG. 2 is a view similar to FIG. 1, but showing an alternate embodiment of the present invention.

An alternate embodiment of the present invention is shown in FIG. 2 and includes cushioning apparatus 50 similar to that described in FIG. 1, but which differs in certain respects therefrom. In FIG. 2, it will be recognized that the components similar to those previously described for FIG. 1 are depicted by like numerals, even if not specifically mentioned in the following detailed description, which will be directed primarily to the differences between the embodiments of FIGS. 1 and 2.

Figure 3:
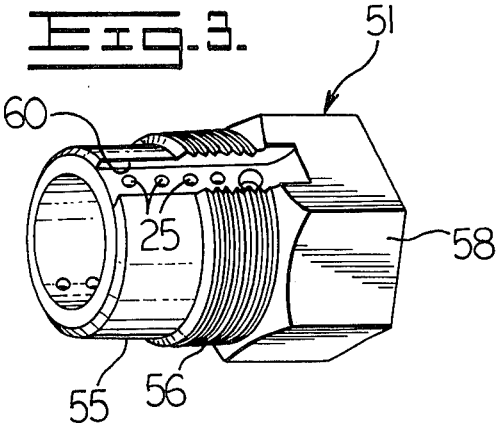
FIG. 3 is an isometric view of the metering sleeve of FIG. 2.

Like the FIG. 1 embodiment, the cushioning apparatus 50 includes a metering sleeve 51 and a plunger 52 reciprocably mounted within such sleeve. The major distinction of the FIG. 2 embodiment is that the plunger sleeve, 51 and 52, are carried by the outer telescopic member 13 rather than the inner telescopic member 14, as in the first embodiment. This is accomplished by providing a blind bore 54 into the inner transverse surface 39 of the end cap 16 of the outer member. As best shown in FIG. 3, the outer periphery of the sleeve 51 is provided with a reduced diameter end portion 55 for receipt within the blind bore 54. The periphery also has an intermediate external screw thread 56 for mating engagement with an internal thread 58 provided in the bore 54 for securing the sleeve to the end cap. The sleeve also preferably has an opposite enlarged end portion provided in the shape of a hex head 58 for accepting a suitable tool to facilitate the mounting of the sleeve to the end cap. A plurality of axial grooves, one of which is shown at 60, are also provided in the periphery of the sleeve in intersecting relationship with the orifices 25 for providing a path from the chamber 26 within the bore 21 of the sleeve for communicating fluid to the chamber 44 between the ends of the inner and outer telescopic members 13 and 14. An elongated stem 62 is screw threadably mounted in to the bottom of the bore 54 in coaxial relation with the sleeve 51 for providing a guide for the biasing sprong 34.

Another distinction of the second embodiment is that the inner telescopic member 14 is provided with a stop member 64 having a transverse surface 65 for abutting engagement with the crown head 38 of the plunger stem 30. The stop member 64 is preferably provided with openings 66 therethrough for communicating fluid on one side thereof to the other.

In operation, as will be readily apparent to those skilled in the art, the cushioning apparatus 50 will function in a like manner to the apparatus 10 of FIG. 1 in decelerating the decent of the outer member 13 toward the inner member 14 so as to prevent the impact of the end cap 16 against an adjacent end 68 of the inner member 14.

While the invention has been described as shown with particular reference to the preferred embodiments, it will be apparent that variations might be possible that would fall within the scope of the present invention, which is not intended to be limited except as defined in the following claims.

What is claimed is:

1. Apparatus for cushioning the movement of one telescopic member of a hydraulic jack toward another, comprising:

wall means carried by one of said telescopic members and forming a blind bore having an open end and an opposite closed end;

a plunger reciprocably mounted within said blind bore for movement between a first position adjacent the open end of the bore and a second position adjacent its closed end and defining a variable chamber therebetween;

surface means carried on the other of said telescopic members for engagement with said plunger to effect the displacement of the plunger toward its second position as the telescopic members approach a predetermined position relative to each other;

a plurality of axially spaced orifices formed through said wall means between said first and second positions of the plunger so as to be sequentially closed off by the plunger as it moves towards its second position, thereby progressively restricting the escape of fluid from the chamber as the plunger approaches its second position;

biasing means for normally biasing said plunger toward its first position;

said plunger has an inner end having a spring cavity formed therein, and said biasing means includes a helical compression spring having one end seated within said spring cavity and its other end seated against the closed end of the blind bore;

a snap ring disposed within a groove formed adjacent the open end of the bore for retaining the plunger therewithin;

said other member has an end cap closing one end thereof, said end cap having an inner transverse surface thereon providing said surface means;

said one member has an end portion adjacent said end cap and said wall means is mounted to said end portion with the open end of said bore facing said end cap of the outer member; and said plunger has an elongated stem extending therefrom, said stem having a distal end extendable from the open end of the bore for engagement with the transverse surface of the end cap.

2. The apparatus of claim 1 wherein said wall means has an outer periphery and including an annular guide member caried about said periphery for guiding relation with the other member.

3. Apparatus for cushioning the movement of one telescopic member of a hydraulic jack toward another, comprising:

wall means carried by one of said telescopic members and forming a blind bore having an open end and an opposite closed end;

a plunger reciprocably mounted within said blind bore for movement between a first position adjacent the open end of the bore and a second position adjacent its closed end and defining a variable chamber therebetween;

surface means carried on the other of said telescopic members for engagement with said plunger to effect the displacement of the plunger toward its second position as the telescopic members approach a predetermined position relative to each other;

a plurality of axially spaced orifices formed through said wall means between said first and second positions of the plunger so as to be sequentially closed off by the plunger as it moves towards its second position, thereby progressively restricting the escape of fluid from the chamber as the plunger approaches its second position;

biasing means for normally biasing said plunger toward its first position;

said plunger has an inner end having a spring cavity formed therein, and said biasing means includes a helical compression spring having one end seated within said spring cavity and its other end seated against the closed end of the blind bore;

a snap ring disposed within a groove formed adjacent the open end of the bore for retaining the plunger therewithin; and said other member has an end cap closing one end thereof, said end cap having an inner transverse surface thereon and a blind bore formed into said surface, and wherein said wall means includes a cylindrical sleeve having a first end portion mounted within said blind bore of the end cap and a second end portion extending therefrom.

4. the apparatus of claim 3 wherein said cylindrical sleeve has an outer periphery including axial groove means intersectingly disposed along said orifices and extending above the inner surface of the end cap for providing an escape route for fluid from said chamber.

5. The apparatus of claim 4 wherein said one member has an end portion adjacent the end cap of said other member, said end portion having a wall member with a transverse surface thereon defining said surface means and in facing relation with said plunger.

6. The apparatus of claim 4 wherein said plunger has an elongated stem extending therefrom and having a distal end extendable from the open end of the blind bore for engagement with the transverse surface of the wall member.

7. The apparatus of claim 6 wherein the distal end of said stem is provided with a crowned head for self-aligning relation with the transverse surface.

8. The apparatus of claim 7 wherein said bore in the end cap is provided with a bottom surface having a coaxial thread bore therein and including an elongated spring guide screw threadably secured within said bore and disposed within said biasing spring.

9. Apparatus for cushioning the movement of one telescopic member of a hydraulic jack toward another, comprising:

wall means carried by one of said telescopic members and forming a blind bore having an open end and an opposite closed end;

a plunger reciprocably mounted within said blind bore biased by a helical compression spring for movement between a first position adjacent the open end of the bore and a second position adjacent its closed end and defining a variable chamber therebetween;

surface means carried on the other of said telescopic members for engagement with said plunger to effect the displacement of the plunger toward its second position as the telescopic members approach a predetermined position relative to each other;

a plurality of axially spaced orifices formed through said wall means between said first and second position of the plunger so as to be sequentially closed off by the plunger as it moves towards its second position, thereby progressively restricting the escape of fluid from the chamber as the plunger approaches its position;

retainer means disposed within a groove formed adjacent the open end of the bore for retaining the plunger therewithin;

said other member has an end cap closing one end thereof, said end cap having an inner transverse surface thereon providing said surface means;

said one member has an end portion adjacent said end cap and said wall means is mounted to said end portion with the open end of said bore facing said end cap of the outer member; and said plunger has an elongated stem extending therefrom, said stem having a distal end extendable from the open end of the bore for engagement with the transverse surface of the end cap.

* * * * *

UNITED STATES PATENT AND TRADEMARK OFFICE

CERTIFICATE OF CORRECTION

PATENT NO. : 4,065,112

DATED : December 27, 1977

INVENTOR(S) : Edward V. Leskovec and Ralph D. Porter

It is certified that error appears in the above-identified patent and that said Letters Patent are hereby corrected as shown below:

Claim 1 - Column 5, line 7 - change "outer" to --- other ---.

Claim 9 - Column 6, line 45 - between "its" and "position;", insert --- second ---.

Claim 9 - Column 6, line 55 - change "outer" to --- other ---.

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*